US011939742B2

(12) United States Patent
Shintani et al.

(10) Patent No.: US 11,939,742 B2
(45) Date of Patent: Mar. 26, 2024

(54) CONTROL DEVICE AND CONTROL METHOD

(71) Applicant: Komatsu Ltd., Tokyo (JP)

(72) Inventors: Satoru Shintani, Tokyo (JP); Yoshito Kumakura, Tokyo (JP); Daiki Arimatsu, Tokyo (JP)

(73) Assignee: Komatsu Ltd., Tokyo (JP)

( * ) Notice: Subject to any disclaimer, the term of this patent is extended or adjusted under 35 U.S.C. 154(b) by 749 days.

(21) Appl. No.: 17/051,064

(22) PCT Filed: Mar. 13, 2019

(86) PCT No.: PCT/JP2019/010143

§ 371 (c)(1),
(2) Date: Oct. 27, 2020

(87) PCT Pub. No.: WO2019/230121

PCT Pub. Date: Dec. 5, 2019

(65) Prior Publication Data

US 2021/0230828 A1 Jul. 29, 2021

(30) Foreign Application Priority Data

May 28, 2018 (JP) ..... 2018-101836

(51) Int. Cl.

| | |
|---|---|
| ***B60W 60/00*** | (2020.01) |
| ***B60W 30/095*** | (2012.01) |
| ***B60W 40/06*** | (2012.01) |
| ***E02F 3/43*** | (2006.01) |
| ***E02F 3/96*** | (2006.01) |
| ***E02F 9/22*** | (2006.01) |
| ***E02F 9/26*** | (2006.01) |
| ***G06N 20/00*** | (2019.01) |

(52) U.S. Cl.

CPC ..... *E02F 3/435* (2013.01); *E02F 3/963* (2013.01); *E02F 9/2228* (2013.01); *E02F 9/265* (2013.01); *E02F 9/2285* (2013.01)

(58) Field of Classification Search

CPC ..... E02F 3/435; E02F 3/963; E02F 9/2228; E02F 9/265; E02F 9/2285

See application file for complete search history.

(56) References Cited

U.S. PATENT DOCUMENTS

| | | | |
|---|---|---|---|
| 2016/0265187 | A1 | 9/2016 | Baba et al. |
| 2019/0093321 | A1 | 3/2019 | Hiekata |

FOREIGN PATENT DOCUMENTS

| | | | |
|---|---|---|---|
| JP | 2010-001613 A | * | 1/2010 |
| JP | 2010001613 | | 1/2010 |
| KR | 10-2010-0074557 | | 7/2010 |
| WO | WO2015/129930 | | 9/2015 |
| WO | WO2017/150134 | | 9/2017 |
| WO | WO2017/159748 | | 9/2017 |

* cited by examiner

*Primary Examiner* — Brian P Sweeney
(74) *Attorney, Agent, or Firm* — Fish & Richardson P.C.

(57) ABSTRACT

A type information input unit receives an input of type information for identifying an attachment. A storage unit stores in advance correspondence between the type information and a weight or weight classification of the attachment. A specification unit specifies a corresponding weight or weight classification based on the type information input to the type information input unit.

13 Claims, 9 Drawing Sheets

1553

PARAMETER STORAGE UNIT

| WEIGHT CLASSIFICATION | CORRELATION DATA |
|---|---|
| LARGE |   |
| MEDIUM |   |
| SMALL |   |

1652

CLASSIFICATION INFORMATION STORAGE UNIT

| WEIGHT RANGE | | WEIGHT CLASSIFICATION |
|---|---|---|
| MODEL OF SPECIFICATION A | MODEL OF SPECIFICATION B | |
| >700 | >900 | LARGE |
| 500～699 | 700～899 | MEDIUM |
| 250～499 | 500～699 | SMALL |

CONTROL DEVICE AND CONTROL METHOD

CROSS-REFERENCE TO RELATED APPLICATIONS

This application is a National Stage application under 35 U.S.C. § 371 of International Application No. PCT/JP2019/010143, filed on Mar. 13, 2019, which claims priority to Japanese Patent Application No. 2018-101836, filed on May 28, 2018. The contents of the prior applications are incorporated herein in their entirety.

TECHNICAL FIELD

The present invention relates to a method for manufacturing a reactor and a reactor.

BACKGROUND ART

Patent Literature 1 discloses a technique for preventing a decrease in excavation accuracy due to a change in load acting on a hydraulic cylinder that drives work equipment due to a difference in weight of buckets. Specifically, according to Patent Literature 1, a control device receives an input of bucket weight classification (large, medium, or small), and among the plurality of pieces of correlation data indicating a relationship between a cylinder speed and an operation command value, the operation command value is output based on the correlation data associated with the input classification.

CITATION LIST

Patent Literature

Patent Literature 1
PCT International Publication No. WO 2015/129930

SUMMARY OF INVENTION

Technical Problem

In the technique described in Patent Literature 1, classification of large, medium, or small indicating the bucket weight classification is input to the control device, but this classification differs depending on the type of bucket. Therefore, when replacing the bucket, the operator needs to grasp the weight of the bucket, specify the classification corresponding to the bucket, and then input the weight. Further, since there are buckets having different shapes such as a slope bucket and a narrow bucket, it is difficult for even a skilled operator to specify the weight classification of various existing buckets.

In addition, there is a possibility that incorrect classification is set, and in this case, there is a possibility that hunting occurs in the intervention control of the work equipment.

An object of the present invention is to provide a control device and a control method capable of easily performing the setting of work equipment in accordance with replacement of a bucket.

Solution to Problem

According to an aspect of the present invention, there is provided a control device for controlling work equipment having an attachment, including a type information input unit that receives an input of type information for identifying the attachment, a storage unit that stores in advance correspondence between the type information and a weight or weight classification of the attachment, and a specification unit that specifies a corresponding weight or weight classification based on the type information input to the type information input unit.

Advantageous Effects of Invention

According to the control device of the above-described aspect, the operator can easily perform the setting of the work equipment in accordance with the replacement of the attachment.

DESCRIPTION OF EMBODIMENTS

Hereinafter, embodiments will be described in detail with reference to the drawings.

<Coordinate System>

Figure 1:
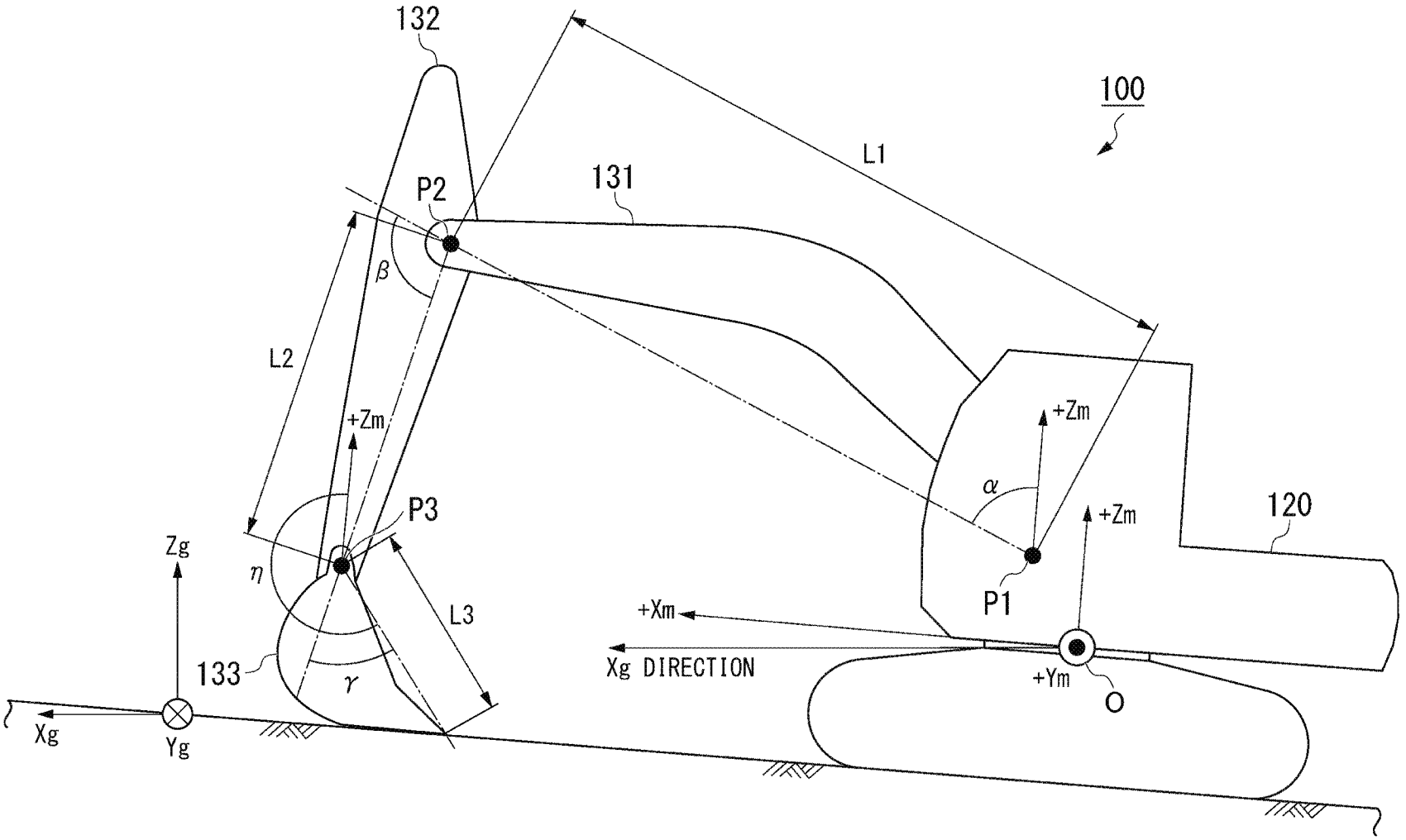
FIG. 1 is a view showing an example of a posture of work equipment.

FIG. 1 is a view showing an example of a posture of work equipment.

In the following description, a three-dimensional site coordinate system (Xg, Yg, Zg) and a three-dimensional vehicle body coordinate system (Xm, Ym, Zm) are defined, and the positional relationship will be described based on these coordinate systems.

The site coordinate system is a coordinate system composed of an Xg axis extending to the north and south, a Yg axis extending to the east and west, and a Zg axis extending in the vertical direction with the position of the GNSS reference station provided at the construction site as a reference point. An example of GNSS is Global Positioning System (GPS).

The vehicle body coordinate system is a coordinate system composed of an Xm axis extending forward and backward, a Ym axis extending leftward and rightward, and a Zm axis extending upward and downward with reference to a representative point O defined on a swing body 120 of a work machine 100 which will be described later. The forward direction is referred to as +Xm direction, the backward direction is referred to as −Xm direction, the leftward direction is referred to as +Ym direction, the rightward direction is referred to as −Ym direction, the upward direction is referred to as +Zm direction, and the downward direction is referred to as −Zm direction with reference to the representative point O of the swing body 120.

A work equipment control device 150 of the work machine 100, which will be described later, can convert a position in one coordinate system into a position in another coordinate system by calculation. For example, the work equipment control device 150 can convert the position in the vehicle body coordinate system into the position in the site coordinate system, and can also convert the position in the opposite coordinate system.

First Embodiment

<<Work Machine>>

Figure 2:
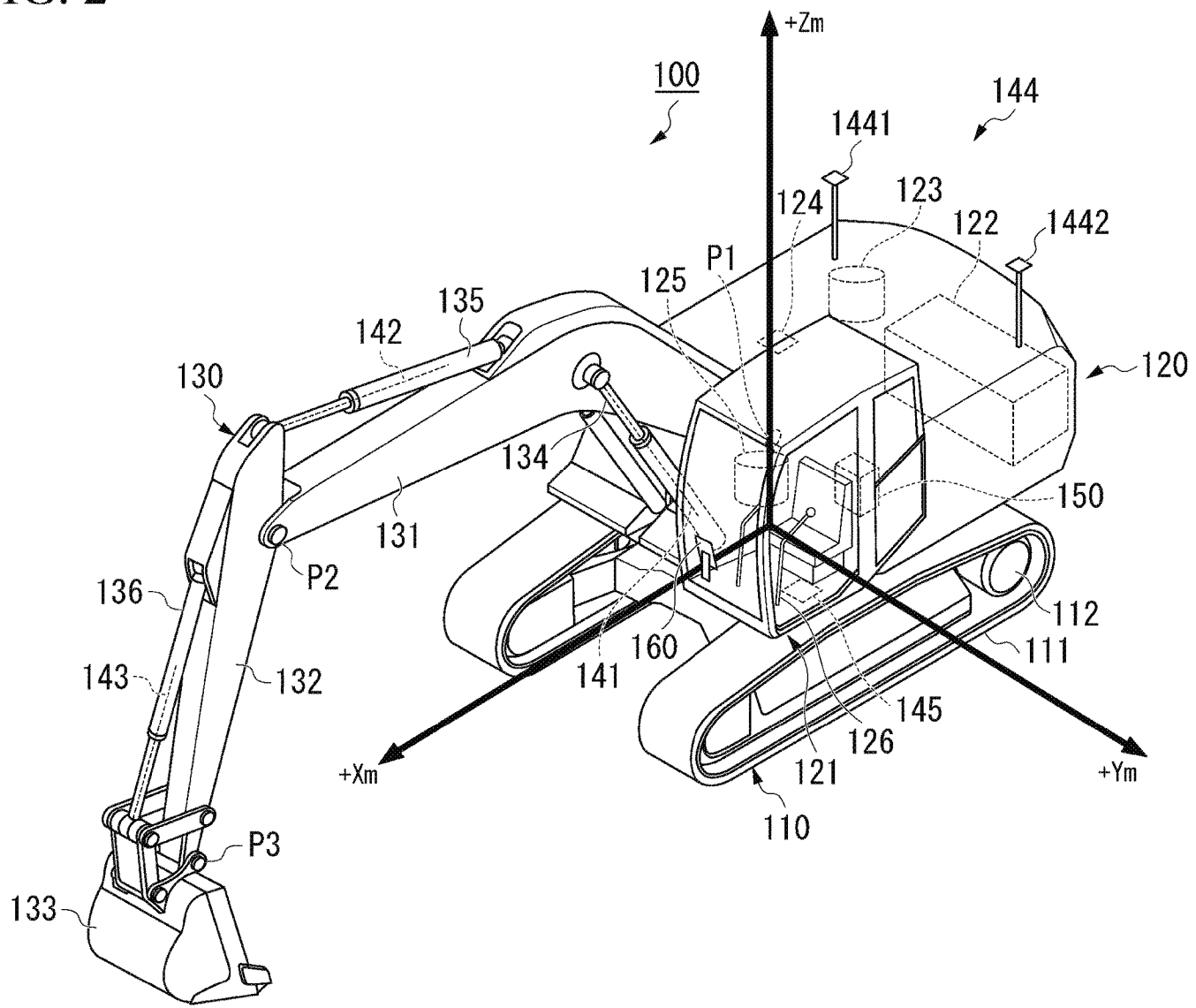
FIG. 2 is a schematic view showing a configuration of a work machine according to a first embodiment.

FIG. 2 is a schematic view showing a configuration of a work machine according to a first embodiment.

The work machine 100 includes a travel body 110, the swing body 120 supported by the travel body 110, and work equipment 130 operated by hydraulic pressure and supported by the swing body 120. The swing body 120 is supported by the travel body 110 so as to be swingable around a swing center.

The travel body 110 includes two endless tracks 111 provided on the left and right and two traveling motors 112 for driving each endless track 111.

The work equipment 130 includes a boom 131, an arm 132, a bucket 133, a boom cylinder 134, an arm cylinder 135, and a bucket cylinder 136.

A base end portion of the boom 131 is attached to the swing body 120 via a boom pin P1.

The arm 132 couples the boom 131 and the bucket 133 to each other. A base end portion of the arm 132 is attached to a tip end portion of the boom 131 via an arm pin P2.

The bucket 133 includes teeth for excavating earth, and an accommodation unit for accommodating the excavated earth. A base end portion of the bucket 133 is attached to a tip end portion of the arm 132 via a bucket pin P3. In addition, the bucket 133 may be a bucket for the purpose of leveling, such as a slope bucket, or may be a bucket that is not provided with the accommodation unit. In addition, in another embodiment, the work equipment 130 may include other attachments such as a breaker for crushing rock by hitting instead of the bucket 133.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. Abase end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the arm 132. A tip end portion of the bucket cylinder 136 is attached to the bucket 133.

The swing body 120 is provided with a cab 121 where an operator boards. The cab 121 is provided in front of the swing body 120 and on the left side of the work equipment 130.

The swing body 120 includes an engine 122, a hydraulic pump 123, a control valve 124, a swing motor 125, an operating device 126, a work equipment control device 150, and an input/output device 160.

The engine 122 is a prime mover that drives the hydraulic pump 123.

The hydraulic pump 123 is driven by the engine 122 and supplies hydraulic oil to each actuator (the boom cylinder 134, arm cylinder 135, the bucket cylinder 136, the traveling motor 112, and the swing motor 125) via the control valve 124.

The control valve 124 controls the flow rate of the hydraulic oil supplied from the hydraulic pump 123 to each actuator for operating the work equipment 130.

The swing motor 125 is driven by the hydraulic oil supplied from the hydraulic pump 123 via the control valve 124 to swing the swing body 120.

The operating device 126 is two levers provided inside the cab 121. The operating device 126 receives a raising and lowering operation of the boom 131, a pushing and pulling operation of the arm 132, an excavating and dumping operation of the bucket 133, and a rightward and leftward swinging operation of the swing body 120, from the operator. The opening degree of the flow path connected to each actuator of the control valve 124 is controlled in accordance with the inclination of the operating device 126. For example, the operating device 126 has a valve that changes the flow rate of the pilot hydraulic oil in accordance with the inclination, and displaces the spool of the control valve 124 in accordance with the flow rate of the pilot hydraulic oil to control the opening degree of the control valve 124. Further, for example, the operating device 126 may include an inclination sensor that detects the inclination, and displace the spool of the control valve 124 in accordance with the magnitude of the output signal of the inclination sensor to control the opening degree of the control valve 124. In addition, the travel body 110 receives a forward operation and a backward operation by a lever (not shown).

The work equipment control device 150 specifies the position and the posture of the bucket 133 in the site coordinate system based on the measured values of a plurality of measuring devices (described later) provided in the work machine 100. Further, the work equipment control device 150 outputs a control command for the boom cylinder 134, a control command for the arm cylinder 135, and a control command for the bucket cylinder 136 to the control valve 124.

The input/output device 160 displays a screen showing the relationship between the bucket 133 of the work machine 100 and the design surface of the construction site. The input/output device 160 also generates an input signal according to an operation of a user and outputs the input signal to the work equipment control device 150. The input/output device 160 is provided in the cab of the work machine 100.

The work machine 100 includes a plurality of measuring devices. Each measuring device outputs the measured value to the work equipment control device 150. Specifically, the work machine 100 includes a boom stroke sensor 141, an arm stroke sensor 142, a bucket stroke sensor 143, a position and azimuth direction calculator 144, and an inclination detector 145.

The boom stroke sensor 141 measures the stroke amount of the boom cylinder 134.

The arm stroke sensor 142 measures the stroke amount of the arm cylinder 135.

The bucket stroke sensor 143 measures the stroke amount of the bucket cylinder 136. Accordingly, the work equipment control device 150 can detect the position and the posture angle of the work equipment 130 including the bucket 133 in the vehicle body coordinate system based on the stroke lengths of each of the boom cylinder 134, the arm cylinder 135, and the bucket cylinder 136. In addition, in another embodiment, instead of the boom cylinder 134, the arm cylinder 135, and the bucket cylinder 136, an inclinometer attached to the work equipment 130, an angle sensor such as an IMU, or another sensor may detect the position and the posture angle of the work equipment 130 in the vehicle body coordinate system.

The position and azimuth direction calculator 144 calculates the position in the site coordinate system of the swing body 120 and the azimuth direction in which the swing body 120 faces. The position and azimuth direction calculator 144 includes a first receiver 1441 and a second receiver 1442 that receive positioning signals from artificial satellites that form the GNSS. The first receiver 1441 and the second receiver 1442 are installed at different positions on the swing body 120, respectively. The position and azimuth direction calculator 144 detects the position of the representative point O (the origin of the vehicle body coordinate system) of the swing body 120 in the site coordinate system based on the positioning signal received by the first receiver 1441.

The position and azimuth direction calculator 144 calculates the azimuth direction in the site coordinate system of the swing body 120 by using the positioning signal received by the first receiver 1441 and the positioning signal received by the second receiver 1442.

The inclination detector 145 measures the acceleration and the angular speed of the swing body 120, and detects the posture (for example, a roll indicating rotation with respect to the Xm axis, a pitch indicating rotation with respect to the Ym axis, and a yaw indicating rotation with respect to the Zm axis) of the swing body 120 based on the measurement result. The inclination detector 145 is installed, for example, on the lower surface of the cab 121. An example of the inclination detector 145 is an Inertial Measurement Unit (IMU).

<<Posture of Work Equipment>>

Here, the position and the posture of the work equipment 130 will be described with reference to FIG. 1. The work equipment control device 150 calculates the position and the posture of the work equipment 130, and generates a control command for the work equipment 130 based on the position and the posture. The work equipment control device 150 calculates a boom relative angle α which is the posture angle of the boom 131 with reference to the boom pin P1, an arm relative angle β which is the posture angle of the arm 132 with reference to the arm pin P2, a bucket relative angle γ which is the posture angle of the bucket 133 with reference to the bucket pin P3, and the position of the teeth of the bucket 133 in the vehicle body coordinate system.

The boom relative angle α is represented by an angle formed by a half line extending from the boom pin P1 in the upward direction (+Zm direction) of the swing body 120 and a half line extending from the boom pin P1 to the arm pin P2. In addition, depending on the posture (pitch angle) θ of the swing body 120, the upward direction (+Zm direction) and the vertically upward direction (+Zg direction) of the swing body 120 do not necessarily match each other.

The arm relative angle β is represented by an angle formed by a half line extending from the boom pin P1 to the arm pin P2 and a half line extending from the arm pin P2 to the bucket pin P3.

The bucket relative angle γ is represented by an angle formed by a half line extending from the arm pin P2 to the bucket pin P3 and a half line extending from the bucket pin P3 to the teeth of the bucket 133.

Here, a bucket absolute angle 11, which is the posture angle of the bucket 133 with respect to the Zm axis of the vehicle body coordinate system, is equal to the sum of the boom relative angle α, the arm relative angle β, and the bucket relative angle γ. The bucket absolute angle 11 is equal to the angle formed by a half line extending from the bucket pin P3 in the upward direction (+Zm direction) of the swing body 120 and a half line extending from the bucket pin P3 to the teeth of the bucket 133.

The position of the teeth of the bucket 133 is obtained from a boom length L1 which is the size of the boom 131, an arm length L2 which is the size of the arm 132, a bucket length L3 which is the size of the bucket 133, the boom relative angle α, the arm relative angle β, the bucket relative angle γ, the shape information of the bucket 133, the position of the representative point O of the swing body 120 in the site coordinate system, and the positional relationship between the representative point O and the boom pin P1. The boom length L1 is the distance from the boom pin P1 to the arm pin P2. The arm length L2 is the distance from the arm pin P2 to the bucket pin P3. The bucket length L3 is the distance from the bucket pin P3 to the teeth of the bucket 133. The positional relationship between the representative point O and the boom pin P1 is represented by the position of the boom pin P1 in the vehicle body coordinate system, for example.

<<Intervention Control>>

The work equipment control device 150 limits the speed in the direction in which the bucket 133 approaches the construction target such that the bucket 133 does not enter the design surface set at the construction site. Hereinafter, limiting the speed of the bucket 133 by the work equipment control device 150 is also referred to as intervention control.

In the intervention control, the work equipment control device 150 generates a control command for the boom cylinder 134 and outputs the control command to the control valve 124 such that the bucket 133 does not enter the design surface in a case where the distance between the bucket 133 and the design surface is less than a predetermined distance. Accordingly, the boom 131 is driven such that the speed of the bucket 133 becomes a speed in accordance with the distance between the bucket 133 and the design surface. In other words, the work equipment control device 150 limits the speed of the bucket 133 by raising the boom 131 according to the control command of the boom cylinder 134.

In addition, in another embodiment, a control command for the arm cylinder 135 or a control command for the bucket cylinder 136 may be output in the intervention control. In other words, in another embodiment, the speed of the bucket 133 may be limited by raising the arm 132 in the intervention control, or the speed of the bucket 133 may be directly limited.

<<Work Equipment Control Device>>

Figure 3:
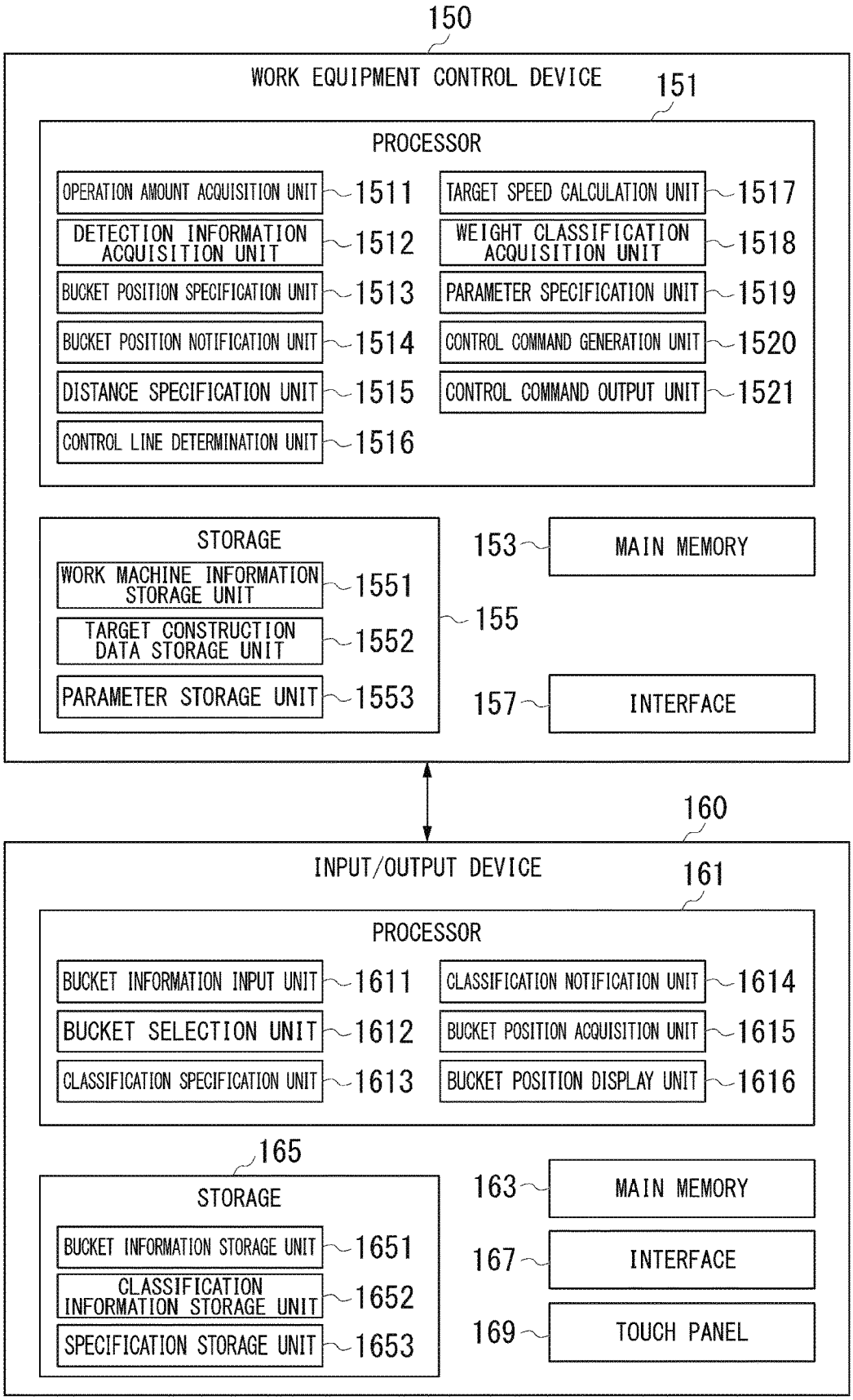
FIG. 3 is a block diagram showing a configuration of a work equipment control device and an input/output device according to the first embodiment.

FIG. 3 is a block diagram showing a configuration of the work equipment control device and the input/output device according to the first embodiment. The work equipment control device 150 and the input/output device 160 are an example of a control device of the work machine 100.

The work equipment control device 150 includes a processor 151, a main memory 153, a storage 155, and an interface 157.

The storage 155 stores a program for controlling the work equipment 130. Examples of the storage 155 include Hard Disk Drive (HDD), Solid State Drive (SSD), and non-volatile memory. The storage 155 may be an internal medium directly connected to the bus of the work equipment control device 150, or an external medium connected to the work equipment control device 150 via the interface 157 or a communication line.

The processor 151 reads the program from the storage 155, expands the program in the main memory 153, and executes the processing according to the program. Further, the processor 151 secures a storage area in the main memory 153 according to the program. The interface 157 is connected to the control valve 124, the operating device 126, the input/output device 160, the boom stroke sensor 141, the arm stroke sensor 142, the bucket stroke sensor 143, the position and azimuth direction calculator 144, the inclination detector 145, and other peripheral devices, and inputs and outputs signals.

The program may be a program for realizing a part of the function to be exerted by the work equipment control device 150. For example, the program may exert a function by a combination with another program already stored in the storage 155 or a combination with another program installed in another device. In addition, in another embodiment, the work equipment control device 150 may include a custom Large Scale Integrated Circuit (LSI) such as a Programmable Logic Device (PLD) in addition to or instead of the above-described configuration. Examples of the PLD include Programmable Array Logic (PAL), Generic Array Logic (GAL), Complex Programmable Logic Device (CPLD), and Field Programmable Gate Array (FPGA). In this case, some or all of the functions realized by the processor may be realized by the integrated circuit.

By executing the program, the processor 151 executes an operation amount acquisition unit 1511, a detection information acquisition unit 1512, a bucket position specification unit 1513, a bucket position notification unit 1514, a distance specification unit 1515, a control line determination unit 1516, a target speed calculation unit 1517, a weight classification acquisition unit 1518, a parameter specification unit 1519, a control command generation unit 1520, and a control command output unit 1521.

Further, the storage area of a work machine information storage unit 1551, a target construction data storage unit 1552, and a parameter storage unit 1553 is secured in the storage 155.

The work machine information storage unit 1551 stores the boom length L1, the arm length L2, the bucket length L3, and the positional relationship between the position of the representative point O of the swing body 120 and the boom pin P1.

The target construction data storage unit 1552 stores target construction data representing the design surface of the construction site. The target construction data is three-dimensional data represented by the site coordinate system, and is stereoscopic geographical data composed of a plurality of triangular polygons representing the design surface. The triangular polygons that forms the target construction data have a common side with other adjacent triangular polygons. In other words, the target construction data represents a continuous plane composed of a plurality of planes. The target construction data is stored in the target construction data storage unit 1552 by being read from an external storage medium or received from an external server via a network N.

Figure 4:
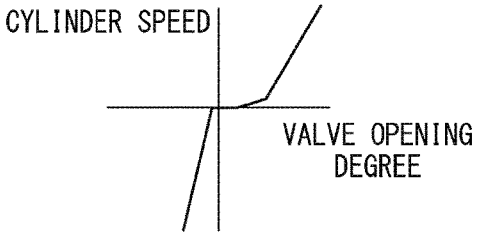
FIG. 4 is an example of information used for control by a control device according to the first embodiment.
Figure 4:
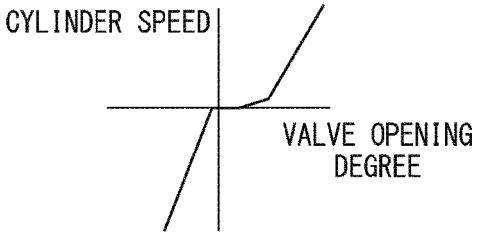
Figure 4:
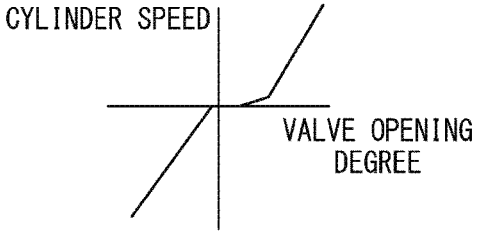

FIG. 4 is an example of information used for control by a control device according to the first embodiment.

As shown in FIG. 4, the parameter storage unit 1553 stores correlation data indicating the relationship between the opening degree of the control valve 124 and the speed of the boom cylinder 134 for each weight classification of the bucket 133. In addition, the number of weight classifications is an example and is not limited to three. Further, the parameter storage unit 1553 may store the correlation data for each weight. The weight classification of the bucket 133 is classification of large, medium, or small determined by the relationship between the weight of the bucket 133 and the specifications of the work machine 100. The correlation data is an example of a parameter related to the opening degree of the control valve 124. In addition, in another embodiment, the parameter specification unit 1519 may store a coefficient by which the reference opening degree is multiplied instead of the correlation data and a program for determining the opening degree of the control valve 124. In addition, the weight classification of the bucket 133, the correlation data, the coefficient by which the reference opening degree is multiplied, and the program for determining the opening degree of the control valve 124 are examples of parameters related to the control. The parameter storage unit 1553 is an example of a storage unit.

The operation amount acquisition unit 1511 acquires an operation signal indicating the operation amount from the operating device 126. The operation amount acquisition unit 1511 acquires at least the operation amount of the boom 131, the operation amount of the arm 132, and the operation amount of the bucket 133.

The detection information acquisition unit 1512 acquires information detected by each of the boom stroke sensor 141, the arm stroke sensor 142, the bucket stroke sensor 143, the position and azimuth direction calculator 144, and the inclination detector 145. In other words, the detection information acquisition unit 1512 acquires the position information of the swing body 120 in the site coordinate system, the azimuth direction in which the swing body 120 faces, the posture of the swing body 120, the stroke length of the boom cylinder 134, the stroke length of the arm cylinder 135, and the stroke length of the bucket cylinder 136.

The bucket position specification unit 1513 specifies the position and the posture of the bucket 133 based on the information acquired by the detection information acquisition unit 1512. At this time, the bucket position specification unit 1513 specifies the bucket absolute angle $\eta$. The bucket position specification unit 1513 specifies the bucket absolute angle $\eta$ in the following order. The bucket position specification unit 1513 calculates the boom relative angle $\alpha$ from the stroke length of the boom cylinder 134. The bucket position specification unit 1513 calculates the arm relative angle $\beta$ from the stroke length of the arm cylinder 135. The bucket position specification unit 1513 calculates the bucket relative angle $\gamma$ from the stroke length of the bucket cylinder 136. Then, the bucket position specification unit 1513 calculates the bucket absolute angle $\eta$ by adding the boom relative angle $\alpha$, the arm relative angle $\beta$, and the bucket relative angle $\gamma$.

Further, the bucket position specification unit 1513 specifies the position of the teeth of the bucket 133 in the site coordinate system based on the information acquired by the detection information acquisition unit 1512 and the information stored in the work machine information storage unit 1551. The bucket position specification unit 1513 specifies the position of the teeth of the work equipment 130 in the site coordinate system in the following order. The bucket position specification unit 1513 specifies the position of the arm pin P2 in the vehicle body coordinate system based on the boom relative angle $\alpha$ acquired by the detection information acquisition unit 1512 and the boom length L1 stored in the work machine information storage unit 1551. The bucket position specification unit 1513 specifies the position of the bucket pin P3 in the vehicle body coordinate system based on the position of the arm pin P2, the arm relative angle $\beta$ acquired by the detection information acquisition unit 1512, and the arm length L2 stored in the work machine information storage unit 1551. The bucket position specification unit 1513 specifies the position and the posture of the teeth of the bucket 133 based on the position of the bucket pin P3, the bucket relative angle γ acquired by the detection information acquisition unit 1512, and the bucket length L3 stored in the work machine information storage unit 1551. Then, the bucket position specification unit 1513 converts the position of the teeth of the bucket 133 in the vehicle body coordinate system to the position in the site coordinate system based on the position information of the swing body 120 in the site coordinate system acquired by the detection information acquisition unit 1512, the azimuth direction in which the swing body 120 faces, and the posture of the swing body 120.

The distance specification unit 1515 specifies the distance between the teeth of the bucket 133 and the design surface. For example, the distance specification unit 1515 specifies the distance between the teeth and the design surface by the following method.

The distance specification unit 1515 specifies each line intersection between a plurality of vertical sections obtained by vertically cutting the bucket 133 and the design surface. The plurality of vertical sections of the bucket 133 include both side surfaces of the bucket 133 and a surface parallel to both the side surfaces and dividing both the side surfaces therebetween. The distance specification unit 1515 obtains the distance between the teeth of the bucket 133 and the specified line intersection on the vertical section for each vertical section.

The control line determination unit 1516 determines a control line used for intervention control of the bucket 133. The control line determination unit 1516 determines, for example, a line intersection between the vertical section of the bucket 133 including the teeth related to the shortest distance specified by the distance specification unit 1515 and the design surface as a control line. In addition, in another embodiment, the vertical section for determining the control line is not limited to the one including the teeth related to the shortest distance, and may be a predetermined surface such as a vertical section passing through the center of the bucket 133 or a manually selected surface.

The bucket position notification unit 1514 notifies the input/output device 160 of the position of the bucket 133 specified by the bucket position specification unit 1513 in the site coordinate system.

Based on the operation amount of the operating device 126 acquired by the operation amount acquisition unit 1511, the target speed calculation unit 1517 determines a target boom relative speed which is a target value of a speed (boom relative speed) of the boom 131 with reference to the boom pin P1, a target arm relative speed which is a target value of a speed (arm relative speed) of the arm 132 with reference to the arm pin P2, and a target bucket relative speed which is a target value of a speed (bucket relative speed) of the bucket 133 with reference to the bucket pin P3.

In addition, hereinafter, the speed which is represented by the sum of the perpendicular components of the boom relative speed, the arm relative speed, and the bucket relative speed, that is, the speed of the bucket 133 in the perpendicular direction with reference to the swing body 120, is referred to as a bucket absolute speed, and the target value of the bucket absolute speed is referred to as a target bucket absolute speed. The target bucket absolute speed is represented by the sum of the perpendicular components of the target boom relative speed, the target arm relative speed, and the target bucket relative speed.

Hereinafter, the perpendicularly downward speed is represented by a positive number, and the perpendicularly upward speed is represented by a negative number.

The weight classification acquisition unit 1518 acquires classification of large, medium, or small of the bucket 133 from the input/output device 160.

The parameter specification unit 1519 specifies the correlation data associated with the classification acquired by the weight classification acquisition unit 1518 from the parameter storage unit 1553.

The control command generation unit 1520 performs intervention control that controls the work equipment 130 such that the bucket 133 does not enter below the control line, based on the distance specified by the distance specification unit 1515. The control command generation unit 1520 determines the speed limit of the boom 131 in the perpendicular direction so as to satisfy the speed table indicating the relationship between the distance between the teeth of the bucket 133 and the control line and the allowable upper limit value of the bucket absolute speed at which the bucket 133 approaches the control line. An example of the speed table is a table in which the allowable upper limit value of the bucket absolute speed approaches 0 as the distance between the teeth of the bucket 133 and the control line approaches 0. In the embodiment, the control command generation unit 1520 determines the speed limit of the boom 131 in the perpendicular direction, but not being limited thereto, may determine the speed limit in the normal direction, for example. For example, the control command generation unit 1520 performs the intervention control in a case where the target bucket absolute speed is higher than the allowable upper limit value of the bucket absolute speed in the speed table. In a case of performing the intervention control, the control command generation unit 1520 calculates the speed limit of the boom 131 in the perpendicular direction by subtracting the sum of the perpendicular components of the target arm relative speed and the target bucket relative speed from the upper limit value of the bucket absolute speed. The control command generation unit 1520 determines the boom relative speed from the speed limit of the boom 131 in the perpendicular direction. On the other hand, the control command generation unit 1520 does not perform the intervention control in a case where the target bucket absolute speed is equal to or lower than the allowable upper limit value of the bucket absolute speed in the speed table. When the intervention control is not performed, the control command generation unit 1520 generates a control command for the boom 131, the arm 132, and the bucket 133 based on the target boom relative speed, the target arm relative speed, and the target bucket relative speed.

At this time, the control command generation unit 1520 generates a control command for controlling the opening degree of the control valve 124 that causes the hydraulic oil to flow to the boom cylinder 134, based on the correlation data specified by the parameter specification unit 1519 and the target boom relative speed. The control command generation unit 1520 is an example of a control unit that determines the control amount of the control valve 124.

The control command output unit 1521 outputs the control command for the boom 131, the control command for the arm 132, and the control command for the bucket 133 generated by the control command generation unit 1520 to the control valve 124.

<<Input/Output Device>>

The input/output device 160 includes a processor 161, a main memory 163, a storage 165, an interface 167, and a touch panel 169.

The storage 165 stores a program for displaying the relationship between the work equipment 130 and the design surface. Examples of the storage 165 include HDD, SSD, and non-volatile memory. The storage 165 may be an internal medium directly connected to the bus of the input/output device 160, or an external medium connected to the input/output device 160 via the interface 167 or a communication line.

The processor 161 reads the program from the storage 165, expands the program in the main memory 163, and executes the processing according to the program. Further, the processor 161 secures a storage area in the main memory 163 according to the program. The interface 167 is connected to the work equipment control device 150, the touch panel 169, and other peripheral devices, and inputs and outputs signals.

The program may be a program for realizing a part of the function to be exerted by the input/output device 160. For example, the program may exert a function by a combination with another program already stored in the storage 165 or a combination with another program installed in another device.

In addition, in another embodiment, the input/output device 160 may include a custom Large Scale Integrated Circuit (LSI) such as a Programmable Logic Device (PLD) in addition to or instead of the above-described configuration. Examples of the PLD include Programmable Array Logic (PAL), Generic Array Logic (GAL), Complex Programmable Logic Device (CPLD), and Field Programmable Gate Array (FPGA). In this case, some or all of the functions realized by the processor may be realized by the integrated circuit.

By executing the program, the processor 161 functions as a bucket information input unit 1611, a bucket selection unit 1612, a classification specification unit 1613, a classification notification unit 1614, a bucket position acquisition unit 1615, and a bucket position display unit 1616. Further, the storage area of a bucket information storage unit 1651, a classification information storage unit 1652, and a specification storage unit 1653 is secured in the storage 165.

The bucket information storage unit 1651 stores the size and the weight or weight classification of the bucket in association with the type information of the bucket 133. Examples of the type information of the bucket 133 include model number, name, and ID of the bucket 133. The bucket information storage unit 1651 is an example of a storage unit. As shown in FIG. 4, the classification information storage unit 1652 stores, for each specification of the work machine 100, a set of the weight classification of the bucket 133 and the weight range of the bucket 133 belonging to the classification. Examples of specifications of the work machine 100 include model number, name, and ID of the work machine 100. The classification information storage unit 1652 is an example of a storage unit.

The specification storage unit 1653 stores specifications of the work machine 100 on which the input/output device 160 is mounted. The specification storage unit 1653 is an example of a storage unit.

The bucket information input unit 1611 receives input of type information, size, and weight or weight classification of the bucket 133, from the user. The bucket information input unit 1611 stores the input information in the bucket information storage unit. The bucket information input unit 1611 is an example of a type information input unit and a weight input unit. The bucket information input unit 1611 according to another embodiment may read type information, size, and weight of the bucket 133 from a Radio Frequency Identifier (RFID) tag embedded in the bucket 133.

The bucket selection unit 1612 causes the touch panel 169 to display a list of the type information of the bucket 133 stored in the bucket information storage unit 1651. The bucket selection unit 1612 receives the selection of the type information of items attached to the work equipment 130 from the user. The bucket selection unit 1612 is an example of a type information input unit.

The classification specification unit 1613 specifies the weight classification of the bucket 133 selected by the bucket selection unit 1612 based on the information stored in the classification information storage unit 1652 and the information stored in the specification storage unit 1653. The classification specification unit 1613 is an example of a specification unit.

The classification notification unit 1614 notifies the work equipment control device 150 of the weight classification specified by the classification specification unit 1613 or the weight classification or weight stored in the bucket information storage unit 1651. The classification notification unit 1614 is an example of a transmission unit.

The bucket position acquisition unit 1615 acquires the bucket absolute angle the position of the bucket 133 in the site coordinate system, and the control line from the work equipment control device 150.

The bucket position display unit 1616 displays the relationship between the bucket 133 and the design surface of the construction site based on the information on the bucket 133 acquired by the bucket position acquisition unit 1615 and the size of the bucket 133 stored in the bucket information storage unit 1651.

<<Bucket Setting Method>>

Hereinafter, a control method of the work machine 100 according to the first embodiment will be described.

First, the operator of the work machine 100 sets the information of the bucket 133 included in the work machine 100 by using the input/output device 160. Here, two types of methods will be described as a setting method of information of the bucket 133 by the input/output device 160.

<<First Setting Method>>

Figure 5:
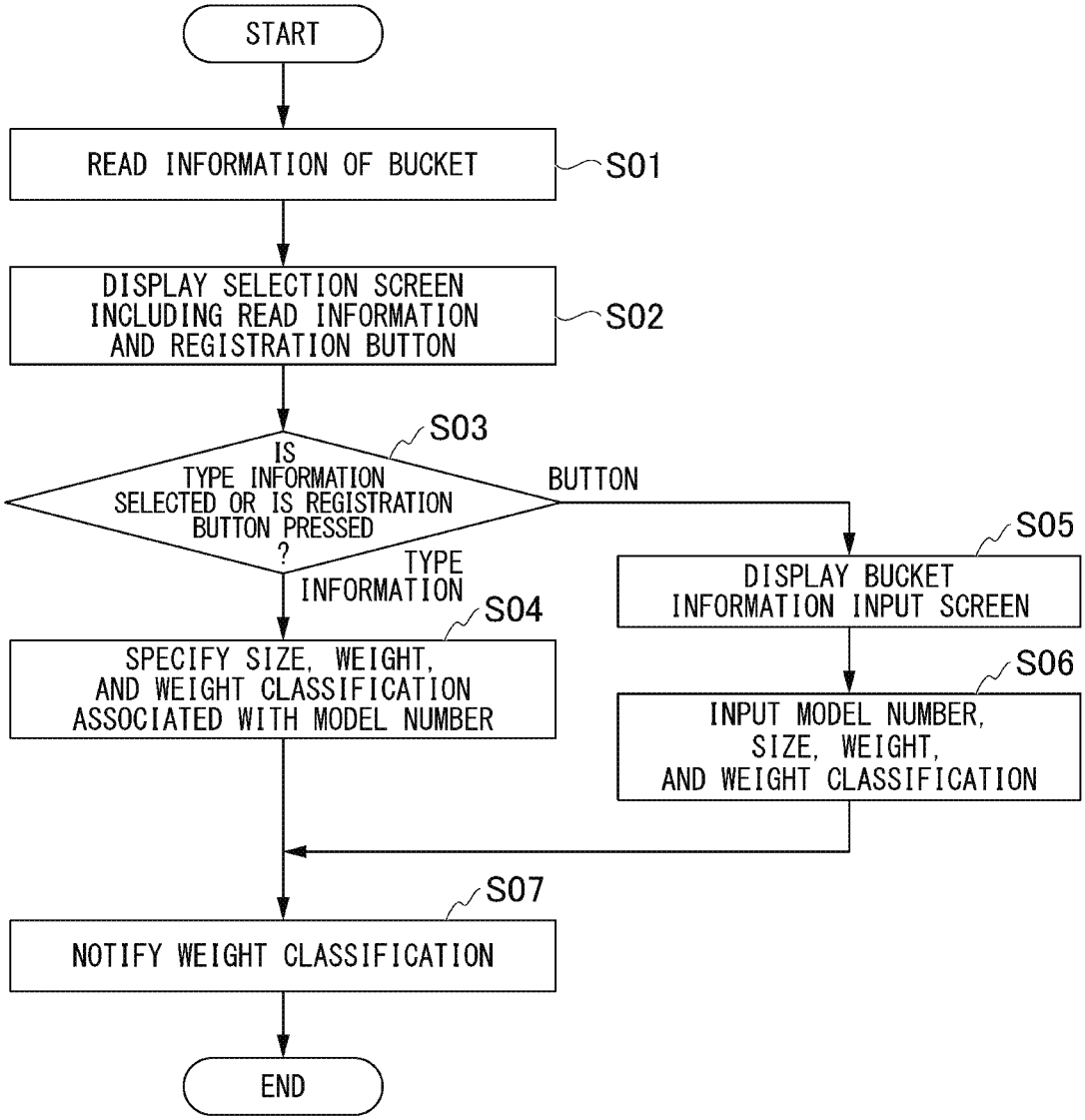
FIG. 5 is a flowchart showing a first setting method of a bucket of the work machine according to the first embodiment.

FIG. 5 is a flowchart showing a first setting method of the bucket of the work machine according to the first embodiment. The weight classification according to the first setting method is a classification uniquely determined only by the weight of the bucket 133.

The bucket selection unit 1612 of the input/output device 160 reads the type information of the bucket 133 stored in the bucket information storage unit 1651 (step S01). The bucket selection unit 1612 outputs a display signal for displaying a selection screen including the read type information of the bucket 133 and the registration button of the new bucket 133, to the touch panel 169 (step S02). Accordingly, the selection screen of the bucket 133 is displayed on the touch panel.

The user searches for the bucket 133 attached to the work machine 100 from the selection screen displayed on the touch panel 169. In a case where there is the attached bucket 133 on the selection screen, the user selects the type information representing the bucket 133 on the selection screen. On the other hand, in a case where there is no attached bucket 133 on the selection screen, the user presses the registration button.

Figure 7:
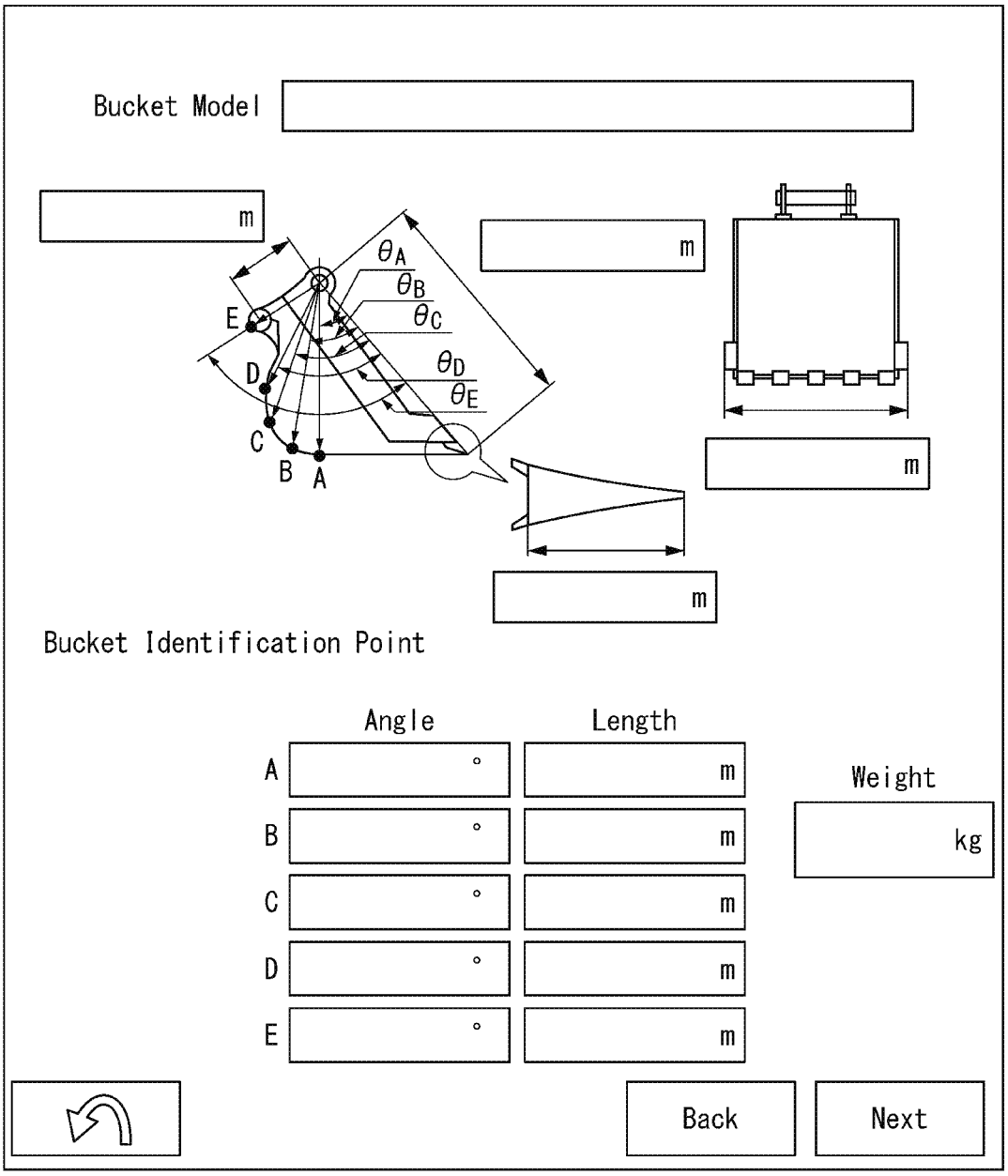
FIG. 7 is an example of a bucket information input screen.

The bucket selection unit 1612 determines whether the type information included in the selection screen has been selected or the registration button has been pressed (step S03). In a case where the type information included in the selection screen is selected (step S03: type information), the bucket selection unit 1612 specifies the size and the weight or weight classification of the bucket 133 associated with the selected type information (step S04). On the other hand, in a case where the registration button is pressed in step S03 (step S03: button), the bucket information input unit 1611 displays the bucket information input screen as shown in FIG. 7 (step S05). FIG. 7 is an example of a bucket information input screen.

On the bucket information input screen, input fields for type information, size, and weight or weight classification of the bucket 133 are displayed. The size of the bucket 133 includes the length from the bucket pin P3 to the teeth, the length and angle from the bucket pin P3 to the plurality of contour points of the bucket 133, the width of the bucket 133, and the length of the teeth of the bucket 133.

The bucket information input unit 1611 receives input of type information, size, and weight or weight classification of the bucket 133, from the user (step S06). The bucket information input unit 1611 causes the bucket information storage unit 1651 to store the input type information, size, and weight or weight classification in association with each other. Accordingly, the type information of the bucket 133 is included in the selection screen generated by the bucket selection unit 1612 from the next time.

When the weight or weight classification is specified in step S04 or step S06, the classification notification unit 1614 notifies the work equipment control device 150 of the specified weight or weight classification (step S07). Accordingly, the weight classification acquisition unit 1518 of the work equipment control device 150 acquires the weight classification from the input/output device 160 and stores the weight classification in the main memory 153. The weight classification acquisition unit 1518 may specify the weight of the bucket 133 associated with the type information and notify the work equipment control device 150 of the specified weight. In this case, the work equipment control device 150 specifies the weight classification corresponding to the weight.

<<Second Setting Method>>

The weight classification is not uniquely determined by the weight, but there is a case where the weight classification represents a weight relative to the specifications of the work machine 100. Specifically, there is a case where this classification is determined by the ratio of the weight of the bucket 133 to the weight of the entire work equipment 130 included in the work machine 100, the relationship between the capacity of the hydraulic pump of the work machine 100 and the weight of the bucket 133, and the like. Even in this case, the classification can be specified by the following second setting method.

Figure 6:
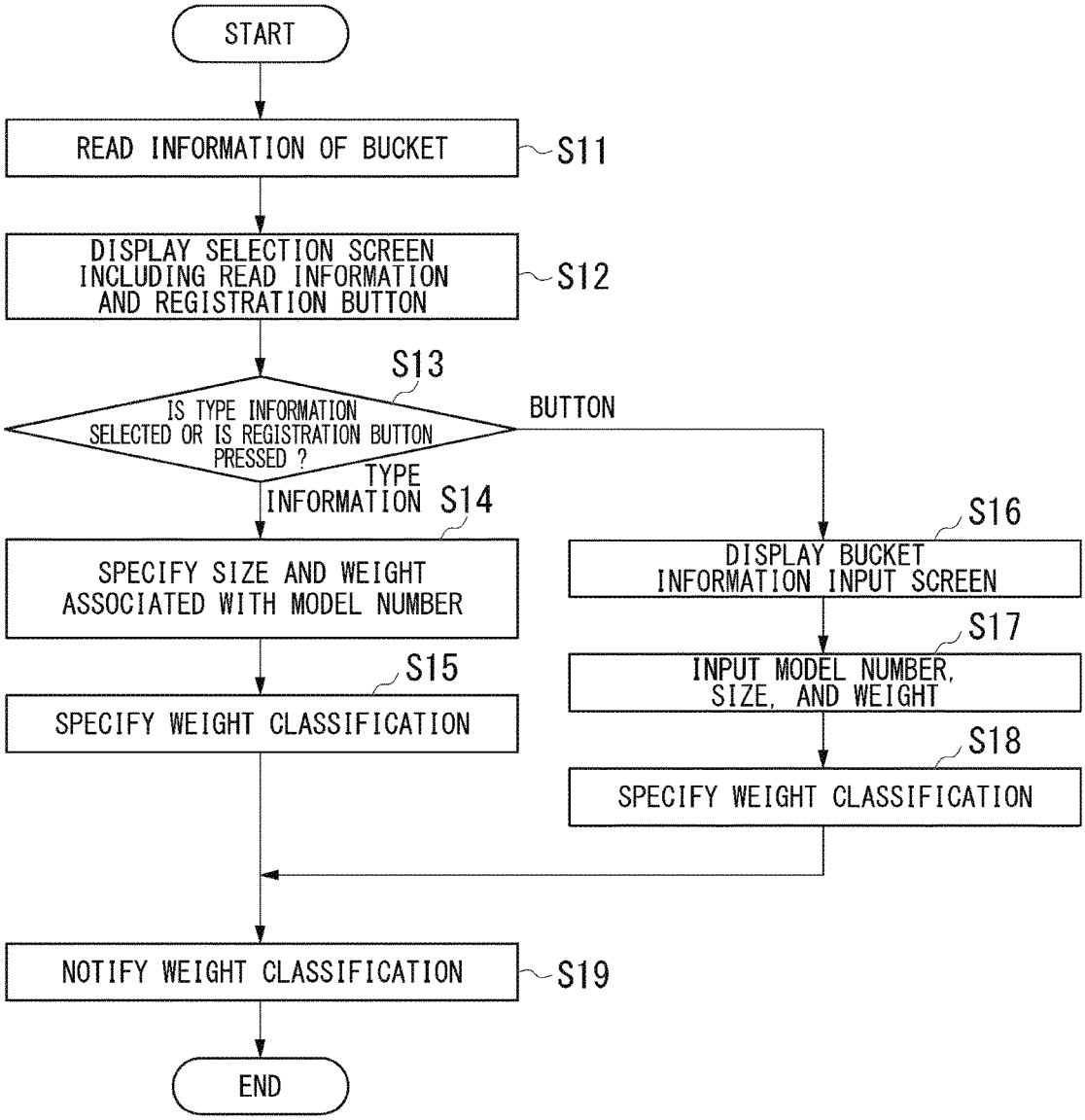
FIG. 6 is a flowchart showing a second setting method of the bucket of the work machine according to the first embodiment.

FIG. 6 is a flowchart showing a second setting method of the bucket of the work machine according to the first embodiment.

The bucket selection unit 1612 of the input/output device 160 reads the type information of the bucket 133 stored in the bucket information storage unit 1651 (step S11). The bucket selection unit 1612 outputs a display signal for displaying a selection screen including the read type information of the bucket 133 and the registration button of the new bucket 133, to the touch panel 169 (step S12). Accordingly, the selection screen of the bucket 133 is displayed on the touch panel.

The user searches for the bucket 133 attached to the work machine 100 from the selection screen displayed on the touch panel 169. In a case where there is the attached bucket 133 on the selection screen, the user selects the type information representing the bucket 133 on the selection screen. On the other hand, in a case where there is no attached bucket 133 on the selection screen, the user presses the registration button.

The bucket selection unit 1612 determines whether the type information included in the selection screen has been selected or the registration button has been pressed (step S13). In a case where the type information included in the selection screen is selected (step S13: type information), the bucket selection unit 1612 specifies the size and the weight of the bucket 133 associated with the selected type information (step S14). The classification specification unit 1613 specifies a set corresponding to the specifications of the work machine 100 stored in the specification storage unit 1653 from the set of the weight classification of the bucket 133 stored in the classification information storage unit 1652 for each specification of the work machine 100 and the weight range of the bucket 133 belonging to the classification. Then, the classification associated with the weight range including the weight specified by the bucket selection unit 1612 is specified (step S15).

On the other hand, in a case where the registration button is pressed in step S13 (step S13: button), the bucket information input unit 1611 displays the bucket information input screen as shown in FIG. 7 (step S16). FIG. 7 is an example of a bucket information input screen.

On the bucket information input screen, input fields for type information, size, and weight of the bucket 133 are displayed. The size of the bucket 133 includes the length from the bucket pin P3 to the teeth, the length and angle from the bucket pin P3 to the plurality of contour points of the bucket 133, the width of the bucket 133, and the length of the teeth of the bucket 133.

The bucket information input unit 1611 receives input of type information, size, and weight of the bucket 133, from the user (step S17). The bucket information input unit 1611 causes the bucket information storage unit 1651 to store the input type information, size, and weight in association with each other. Accordingly, the type information of the bucket 133 is included in the selection screen generated by the bucket selection unit 1612 from the next time.

The classification specification unit 1613 specifies the weight classification stored in the classification information storage unit 1652 in association with the weight range including the input weight and the specifications of the work machine 100 stored in the specification storage unit 1653, by the same method as that in step S15 (step S08).

When the weight classification is specified in step S5 or step S8, the classification notification unit 1614 notifies the work equipment control device 150 of the specified weight classification (step S09). Accordingly, the weight classification acquisition unit 1518 of the work equipment control device 150 acquires the weight classification from the input/output device 160 and stores the weight classification in the main memory 153.

<<Work Equipment Control Method>>

Figure 8:
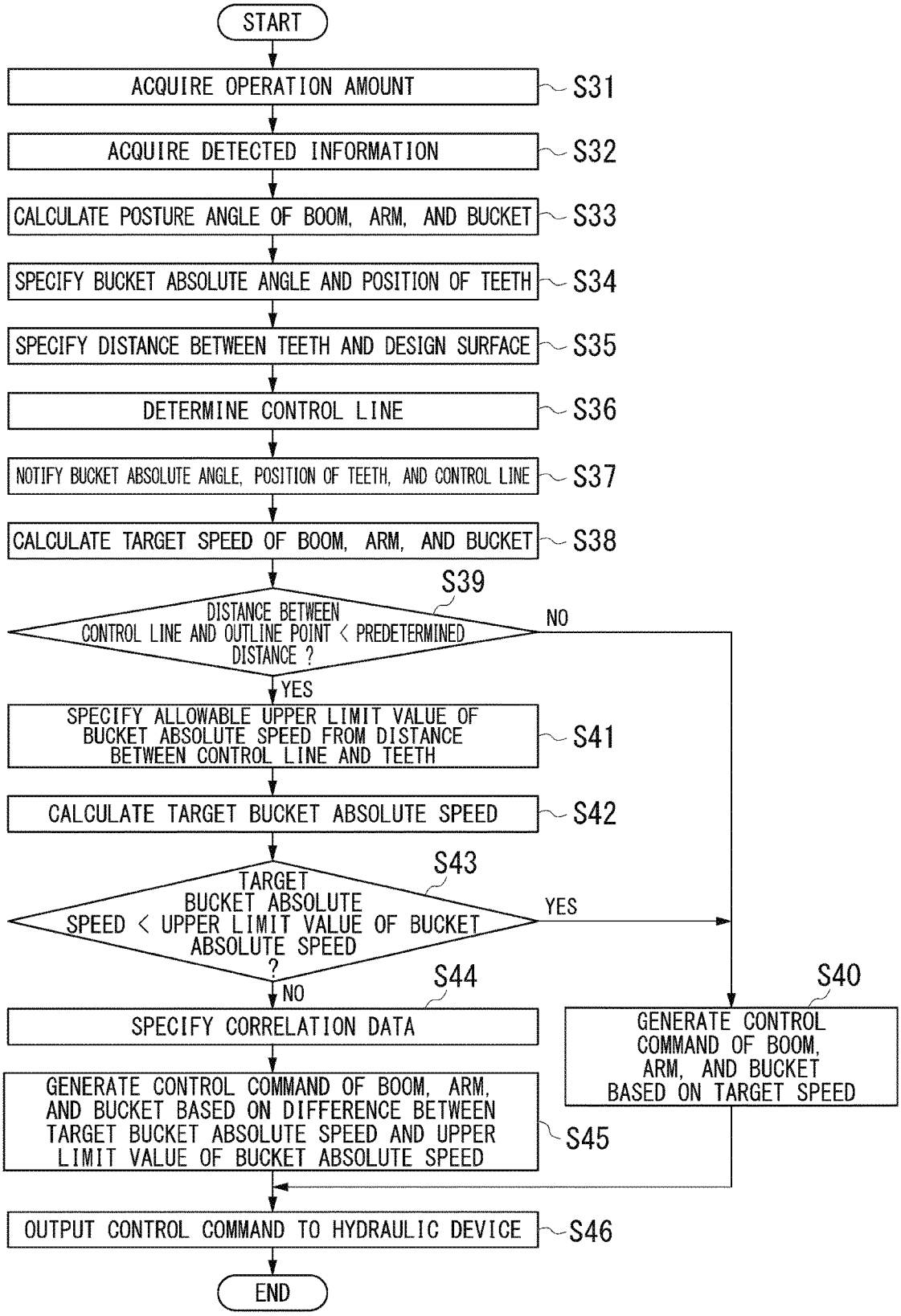
FIG. 8 is a flowchart showing an operation of the work equipment control device according to the first embodiment.

FIG. 8 is a flowchart showing intervention control processing using the weight classification set in the first embodiment. When the operator of the work machine 100 starts to operate the work machine 100, the work equipment control device 150 executes the following control for each predetermined control cycle.

The operation amount acquisition unit 1511 acquires the operation amount of the boom 131, the operation amount of the arm 132, the operation amount of the bucket 133, and the operation amount of swinging from the operating device 126 (step S31). The detection information acquisition unit 1512 acquires information detected by each of the position and azimuth direction calculator 144, the inclination detector 145, and a stroke detector 137 (step S32).

The bucket position specification unit 1513 calculates the boom relative angle α, the arm relative angle β, and the bucket relative angle γ from the stroke length of each hydraulic cylinder (step S33). In addition, the bucket position specification unit 1513 calculates the bucket absolute angle η and the position of the teeth of the bucket 133 in the site coordinate system based on the calculated relative angles α, β, and γ, the boom length L1, the arm length L2, the bucket length L3, and the shape information of the bucket 133 which are stored in the work machine information storage unit 1551, and the position, azimuth direction, and posture of the swing body 120 which are acquired by the detection information acquisition unit 1512 (step S34).

The distance specification unit 1515 specifies the distance between the teeth of the bucket 133 and the design surface represented by the target construction data stored in the target construction data storage unit 1552 (step S35). The control line determination unit 1516 determines the control line based on the distance specified by the distance specification unit 1515 (step S36).

The bucket position notification unit 1514 notifies the input/output device 160 of the bucket absolute angle η and the position of the teeth specified by the bucket position specification unit 1513, and the control line determined by the control line determination unit 1516 (step S37).

The target speed calculation unit 1517 calculates the target boom relative speed, the target arm relative speed, and the target bucket relative speed based on the operation amount acquired by the operation amount acquisition unit 1511 in step S31 (step S38).

The control command generation unit 1520 determines whether or not the distance specified by the distance specification unit 1515 is less than the predetermined distance (step S39). In a case where the distance between the control line and the teeth of the bucket 133 is equal to or greater than the predetermined distance (step S39: NO), the control command generation unit 1520 does not perform the intervention control. In a case where the intervention control is not performed, the control command generation unit 1520 generates the control command for the boom 131, the arm 132, and the bucket 133 based on the target boom relative speed, the target arm relative speed, and the target bucket relative speed (step S40).

On the other hand, in a case where the distance between the control line and the teeth of the bucket 133 is less than the predetermined distance (step S39: YES), the control command generation unit 1520 performs the intervention control. In a case of performing the intervention control, the control command generation unit 1520 specifies the allowable upper limit value of the bucket absolute speed based on the distance specified by the distance specification unit 1515 and the above-described speed table stored in the work machine information storage unit 1551 (step S41). Next, the control command generation unit 1520 calculates the target bucket absolute speed based on the perpendicular components of the target boom relative speed, the target arm relative speed, and the target bucket relative speed calculated in step S38 (step S42). Next, the control command generation unit 1520 determines whether or not the target bucket absolute speed calculated in step S13 is lower than the allowable upper limit value of the bucket absolute speed specified in step S41 (step S43).

In a case where the target bucket absolute speed is lower than the allowable upper limit value of the bucket absolute speed (step S43: YES), the control command generation unit 1520 generates a control command for the boom 131, the arm 132, and the bucket 133 based on the target boom relative speed, the target arm relative speed, and the target bucket relative speed (step S40). On the other hand, in a case where the target bucket absolute speed is equal to or higher than the allowable upper limit value of the bucket absolute speed (step S43: NO), the parameter specification unit 1519 specifies the correlation data associated with the weight classification stored in the main memory 153 from the parameter storage unit 1553 (step S44). Then, the control command generation unit 1520 generates the control command for the boom 131, the arm 132, and the bucket 133 based on the specified correlation data and the difference between the target bucket absolute speed and the bucket absolute speed (step S45).

When the control command generation unit 1520 generates the control command for the boom 131, the arm 132, and the bucket 133, the control command output unit 1521 outputs the control command to the control valve 124 (step S46). Accordingly, the control valve 124 drives the boom cylinder 134, the arm cylinder 135, and the bucket cylinder 136.

<<Display Method of Bucket>>

Figure 9:
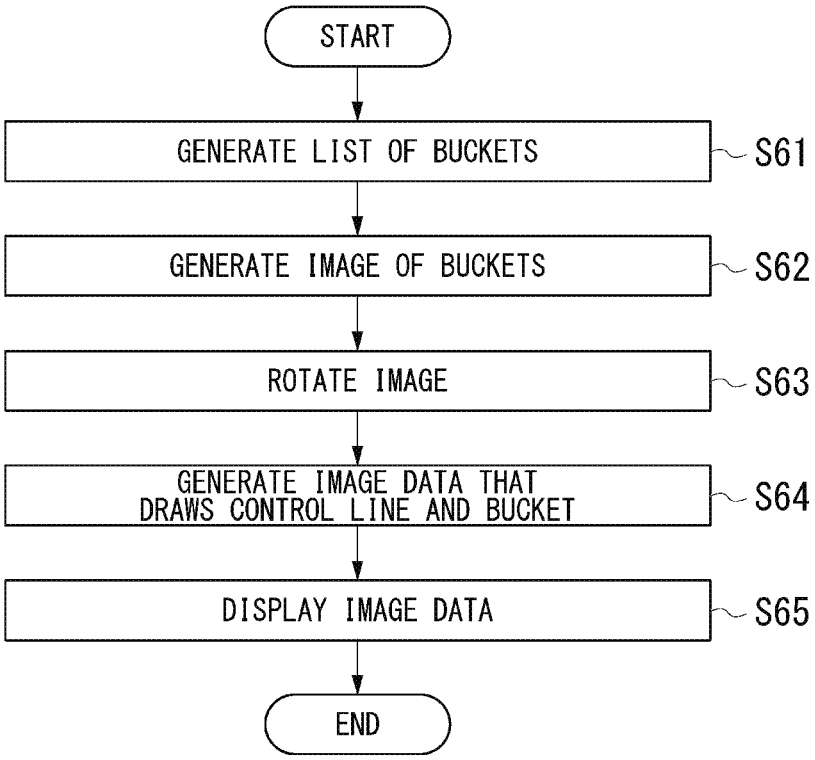
FIG. 9 is a flowchart showing a display operation by the input/output device according to the first embodiment.

FIG. 9 is a flowchart showing a display operation by the input/output device using the size of the bucket specified or input in the first embodiment. When the operator of the work machine 100 starts to operate the work machine 100, the input/output device 160 executes the following control for each predetermined control cycle.

The bucket position acquisition unit 1615 of the input/output device 160 acquires the bucket absolute angle η, the position of the teeth of the bucket 133 in the site coordinate system, and the control line from the work equipment control device 150 (step S61). The bucket position display unit 1616 generates an image of the bucket 133 based on the size of the bucket 133 specified by the bucket selection unit 1612 or input by the bucket information input unit 1611 (step S62). The bucket position display unit 1616 rotates the generated image based on the bucket absolute angle η (step S63). The bucket position display unit 1616 converts the acquired position of the teeth and the control line into the image coordinate system, and generates screen data in which the line segment representing the control line and the image of the bucket 133 are drawn (step S64). The bucket position display unit 1616 outputs the generated screen data to the touch panel 169 (step S65). Accordingly, a screen showing the positional relationship between the bucket 133 and the design surface is displayed on the touch panel 169.

<<Operation and □Effects>>

According to the first setting method of the first embodiment, the control device (the work equipment control device 150 and the input/output device 160) receives the input of the type information of the bucket 133, and the bucket information storage unit 1651 can specify the weight classification of the bucket 133 or the weight of the bucket 133. Therefore, the operator does not need to specify the weight classification of the bucket 133 or the weight of the bucket 133 when the bucket 133 is replaced. Accordingly, the operator can easily perform the setting of the work equipment 130 associated with the replacement of the bucket 133.

According to the second setting method of the first embodiment, the control device (the work equipment control device 150 and the input/output device 160) receives the input of the type information of the bucket 133, and the weight of the bucket 133 can be specified by the classification specification unit 1613, the classification information storage unit 1652, and the specification storage unit 1653. Therefore, even in a case where the weight classification is not uniquely determined by the weight depending on the specifications of the work machine, the operator can easily perform the setting of the work equipment 130 associated with the replacement of the bucket 133.

In the control device according to the first embodiment, the type information of the bucket 133 is selected from the list, but the invention is not limited thereto. For example, in the control device according to another embodiment, the type information of the bucket 133 may be text-input.

Further, the control device according to the first embodiment specifies the weight associated with the input type information in the information stored in the bucket information storage unit 1651, and determines the control amount of the control valve 124 based on the correlation data associated with the specified weight. In other words, the control device according to the first embodiment can perform the setting of the bucket 133 by storing the relationship between the weight and the correlation data for each model of the work machine 100. In addition, in another embodiment, the control device may store a table in which the type information of the bucket 133 and the direct correlation data are directly associated with each other. In this case, the control device does not need to specify the weight of the bucket 133 from the type information. In addition, the control device according to another embodiment may store a table in which the type information of the bucket 133 is associated with the weight classification of large, medium, or small. In another embodiment, the control device may control the bucket 133 without specifying the weight classification by using a function having variables of the weight of the bucket 133 and the control amount.

Further, in the control device according to the first embodiment, the input/output device 160 specifies the weight classification of large, medium and small based on the weight, and the work equipment control device 150 determines the control amount of the control valve 124 based on the correlation data associated with the classification. In other words, the control device according to the first embodiment can perform the setting based on the type information of the bucket 133 without changing the work equipment control device 150 of the related art in which the classification of small, medium, and large and the correlation data are associated with each other.

Further, the control device according to the first embodiment receives the input of the weight of the bucket related to the input type information, and writes the type information and the weight in the bucket information storage unit in association with each other. Accordingly, the control device can include the bucket type information in the list after receiving the input of the type information and the weight of the bucket. Thereby, the operator can easily perform the setting of the bucket 133 when the same bucket 133 is replaced for the second time and thereafter. In addition, the control device according to another embodiment may store the information of the plurality of buckets 133 in the bucket information storage unit 1651 in advance and may not receive the input of the information of the new bucket 133.

Another Embodiment

Above, the embodiment has been described in detail with reference to the drawings, but the specific configuration is not limited to the above-described configuration, and various design changes can be made.

For example, the control device according to the above-described embodiment is realized by a combination of the work equipment control device 150 and the input/output device 160, but is not limited thereto in another embodiment. For example, the control device according to another embodiment may be realized by one device, or may be realized by a combination of three or more devices. Further, the combination of the function of the work equipment control device 150 and the function of the input/output device 160 is not limited to the example of the first embodiment. For example, in the control device according to the first embodiment, the input/output device 160 includes the bucket information storage unit 1651, the classification information storage unit 1652, and the specification storage unit 1653, but in the control device according to another embodiment, the work equipment control device 150 may include any or all of the bucket information storage unit 1651, the classification information storage unit 1652, and the specification storage unit 1653. Further, the work equipment control device 150 includes a work machine information storage unit 1551, a target construction data storage unit 1552, and a parameter storage unit 1553. However, in the control device according to another embodiment, the input/output device 160 may include any or all of the work machine information storage unit 1551, the target construction data storage unit 1552, and the parameter storage unit 1553.

Further, the control device according to the above-described embodiment performs the intervention control shown in FIG. 8 and the display control of the bucket shown in FIG. 9, but the invention is not limited thereto. For example, the control device according to another embodiment may not perform the intervention control or the display control of the bucket. In a case where the control device does not perform the intervention control, the work machine 100 may not include the position and azimuth direction calculator 144, the inclination detector 145, and the work equipment control device 150. In a case where the control device does not perform the display control of the bucket, the work machine 100 may not include the input/output device 160.

In addition, the control device according to another embodiment may not have to display the relationship between the bucket 133 and the design surface.

Further, the control valve 124 according to the above-described embodiment converts the position of the arm 132 from the vehicle body coordinate system to the site coordinate system in order to display the image data in which the control line and the arm 132 are drawn, but the invention is not limited thereto. For example, in another embodiment, the control valve 124 may convert the position of the design surface indicated by the target construction data from the site coordinate system to the vehicle body coordinate system. Further, in another embodiment, the control valve 124 may convert the positions of the control line and the arm 132 in another coordinate system.

INDUSTRIAL APPLICABILITY

According to the control device of the invention, the operator can easily perform the setting of the work equipment in accordance with the replacement of the attachment.

The invention claimed is:

1. A control device for controlling work equipment having an attachment, the control device comprising:

a processor configured to receive an input of type information for identifying the attachment; and a memory that stores in advance correspondence data between type information of a plurality of attachments for the work equipment and a weight or weight classification of each of the plurality of attachments, wherein the processor is further configured to determine a corresponding weight or weight classification from the correspondence data based on the input of the type information.

2. The control device according to claim 1, wherein a shape of the attachment is different from a shape of another attachment among the plurality of attachments.

3. The control device according to claim 1, wherein the processor is further configured to transmit the weight or the weight classification to a control unit that controls the work equipment.

4. The control device according to claim 3, wherein the memory further stores correspondence between the weight or the weight classification and a parameter related to control of the work equipment, and wherein the processor is further configured to transmit the parameter related to the control of the work equipment corresponding to the weight or the weight classification to the control unit that controls the work equipment.

5. The control device according to claim 4, wherein the parameter includes a parameter related to an opening degree of a valve that controls an amount of hydraulic oil supplied to an actuator for operating the work equipment, and wherein the control unit is configured to determine a control amount of the valve based on the parameter associated with the type information.

6. The control device according to claim 1, wherein the memory further stores specifications of the work equipment and the correspondence data between the weight and the weight classification of the attachment for each specification of the work equipment, and wherein the processor is further configured to determine the weight classification based on the specifications of the work equipment and the weight of the attachment.

7. The control device according to claim 1, wherein the processor is further configured to:

receive an input of the weight or the weight classification of the attachment corresponding to the type information; and provide the memory with the weight or the weight classification of the attachment corresponding to the type information.

8. A control method comprising:

receiving an input of type information of an attachment for work equipment; and determining a corresponding weight or weight classification based on the input of the type information from a memory that stores in advance correspondence data between type information of a plurality of attachments for the work equipment and a weight or weight classification of each of the plurality of attachments.

9. The control method according to claim 8, further comprising:

transmitting the weight or the weight classification to a control unit that controls the work equipment.

10. The control method according to claim 9, further comprising:

storing, in the memory, correspondence between the weight or the weight classification and a parameter related to control of the work equipment; and transmitting the parameter related to the control of the work equipment corresponding to the weight or the weight classification to the control unit that controls the work equipment.

11. The control method according to claim 10, wherein the parameter includes a parameter related to an opening degree of a valve that controls an amount of hydraulic oil supplied to an actuator for operating the work equipment, and wherein the control unit is configured to determine a control amount of the valve based on the parameter associated with the type information.

12. The control method according to claim 8, further comprising:

storing, in the memory, specifications of the work equipment and the correspondence data between the weight and the weight classification of the attachment for each specification of the work equipment; and determining the weight classification based on the specifications of the work equipment and the weight of the attachment.

13. The control method according to claim 8, further comprising:

receiving an input of the weight or the weight classification of the attachment corresponding to the type information; and providing the memory with the weight or the weight classification of the attachment corresponding to the type information.

* * * * *